United States Patent [19]

Calderone

[11] 4,266,766

[45] May 12, 1981

[54] EXERCISE DEVICE

[76] Inventor: Michael P. Calderone, 23768 Wilmont, East Detroit, Mich. 48021

[21] Appl. No.: 61,639

[22] Filed: Jul. 30, 1979

[51] Int. Cl.[3] ..... A63B 23/00

[52] U.S. Cl. ..... 272/117; 272/134

[58] Field of Search ..... 272/117, 122, 123, 118, 272/124, 125, 144, 143, DIG. 2, 93, 134, 109

[56] References Cited

U.S. PATENT DOCUMENTS

| | | | |
|---|---|---|---|
| 4,999 | 7/1872 | Forward | 272/117 |
| 157,467 | 12/1874 | Wahl | 272/144 |
| 2,673,737 | 3/1954 | Daniels | 272/144 |
| 2,932,509 | 4/1960 | Zinkin | 272/144 |
| 3,269,768 | 8/1966 | Kinney | 272/144 |
| 3,573,865 | 4/1971 | Annas et al. | 272/117 |
| 3,850,430 | 11/1974 | Hamilton | 272/117 |

*Primary Examiner*—Richard C. Pinkham

*Assistant Examiner*—T. Brown

*Attorney, Agent, or Firm*—Basile, Weintraub & Hanlon

[57] ABSTRACT

An apparatus for the development of upper body parts and muscles is disclosed. The apparatus includes a base on which is mounted a seat supported above the base and a forearm pad disposed forward of the seat and supported above the base. A pivoted lever is pivoted at a first end to a seat support, a second end of the lever extends past the forearm pad a distance and includes a weight supporting pin which extends vertically upward. A lifting device is selectively and pivotally attached to the pivoted lever forward of the forearm rest. A plurality of weights are selectively attached to the weight support pin to vary the amount of force required to use the lifting device and raise the weights. A variety of attachments are selectively affixed to the lifting device to exercise various body parts and muscles.

16 Claims, 4 Drawing Figures

EXERCISE DEVICE

BACKGROUND OF THE INVENTION

I. Field of the Invention

The present invention relates to the field of exercise devices, and more particularly the present invention relates to the field of exercise devices for developing the upper body parts and muscles. Even more particularly the present invention relates to the field of exercise devices for developing muscles of the shoulders, upper arms, forearms, wrists, and back.

II. Description of the Prior Art

A search of the issued U.S. patents in the field of muscular exercising devices and apparatus reveals U.S. Patents related to the field of the present invention but which do not anticipate nor disclose the device of the present invention. The discovered U.S. Patents relating to the present invention are discussed hereinbelow.

U.S. Pat. No. 3,573,865 discloses an exercise device wherein the user pushes against an arcuately movable pedal which is connected through a mechanism to pivot a weighted beam about a fixed fulcrum. A seat is provided against which the user of the device rests while employing the device. This device employs cables and pulleys in its operation.

U.S. Pat. No. 3,858,873 discloses an apparatus for development of body parts. The apparatus includes a frame on which is mounted a force applying member against which the user exerts a force for developing body parts and muscles. The device employs a seat for supporting the user, and a system of cables and pulleys is employed to exert force against the force applying member. The force exerted is continuously varied over the full range of rotation of the force applying member.

U.S. Pat. No. 3,285,070 discloses an exercise apparatus employing a hinged weighted arm affixed to one end of a table or support. Resistance against motion is provided by a clutch which is adjustable to vary the amount of resistance imposed.

None of the above listed U.S. Patents disclose nor anticipate an exercise device comprising a base with a seat supported above the base, a forearm pad disposed forward of the seat and supported above the base, a pivoted lever pivoted at a first end to a seat support and including a second end extending past the forearm pad a distance, a weight supporting pin extending vertically upward from the lever second end, an attachment post pivotally attached to the pivoted lever forward of the forearm rest, a lifting means selectively attached to the lifting post, and a plurality of weights selectively attached to the weight support pin to vary the amount of force required to raise the lifting means.

SUMMARY OF THE INVENTION

Its an object of the present invention to provide an exercise device for exercising and developing body parts and muscles.

It is also an object of this invention to provide a device for exercising upper body parts and muscles wherein the force required to operate the device can be varied by varying the amount of weight attached to the device.

It is a further object of the present invention to provide an exercise device that is operated by the hands of the user.

It is also a further object of the present invention to provide an exercise device operated by the hands of the user which provides a variety of hand engageable lifting means wherein the user's hand can grasp the lifting means with the palms of the hands deployed in a variety of attitudes.

The exercise device of the present invention comprises a base resting on a floor, a seat supported above the base, a forearm pad disposed forward of the seat and supported above the base. A pivoted lever is pivoted at a first end to a seat support includes a second end extending past the forearm pad a distance. A weight supporting pin extends vertically upward from the lever second end, and weights are provided which can be slid over the pin to vary the amount of weight employed in using the exercise device. An attachment post is pivotally attached to the pivoted lever forward of the forearm rest and a lifting means is selectively attached to the lifting post, which lifting means is grasped by the user's hands to lift the weights. The lifting means comprises a variety of selectively attached devices which are attached to the attachment post allowing the user to grasp the lifting means in a palms up wrist curl attitude, a palms down wrist curl attitude, or in a palms facing each other attitude.

For a more complete understanding of the present invention reference is made to the following detailed description and accompanying drawing.

Other objects, advantages, and applications of the present invention will become apparent to those skilled in the field to which this invention pertains, when the accompanying description of the best modes contemplated for practicing the invention are read in conjunction with the accompanying drawing.

BRIEF DESCRIPTION OF THE DRAWING

In the drawing, like reference numbers refer to like parts throughout the several views, and wherein.

DESCRIPTION OF THE PREFERRED EMBODIMENT

Figures 1, 2, 3, 4:
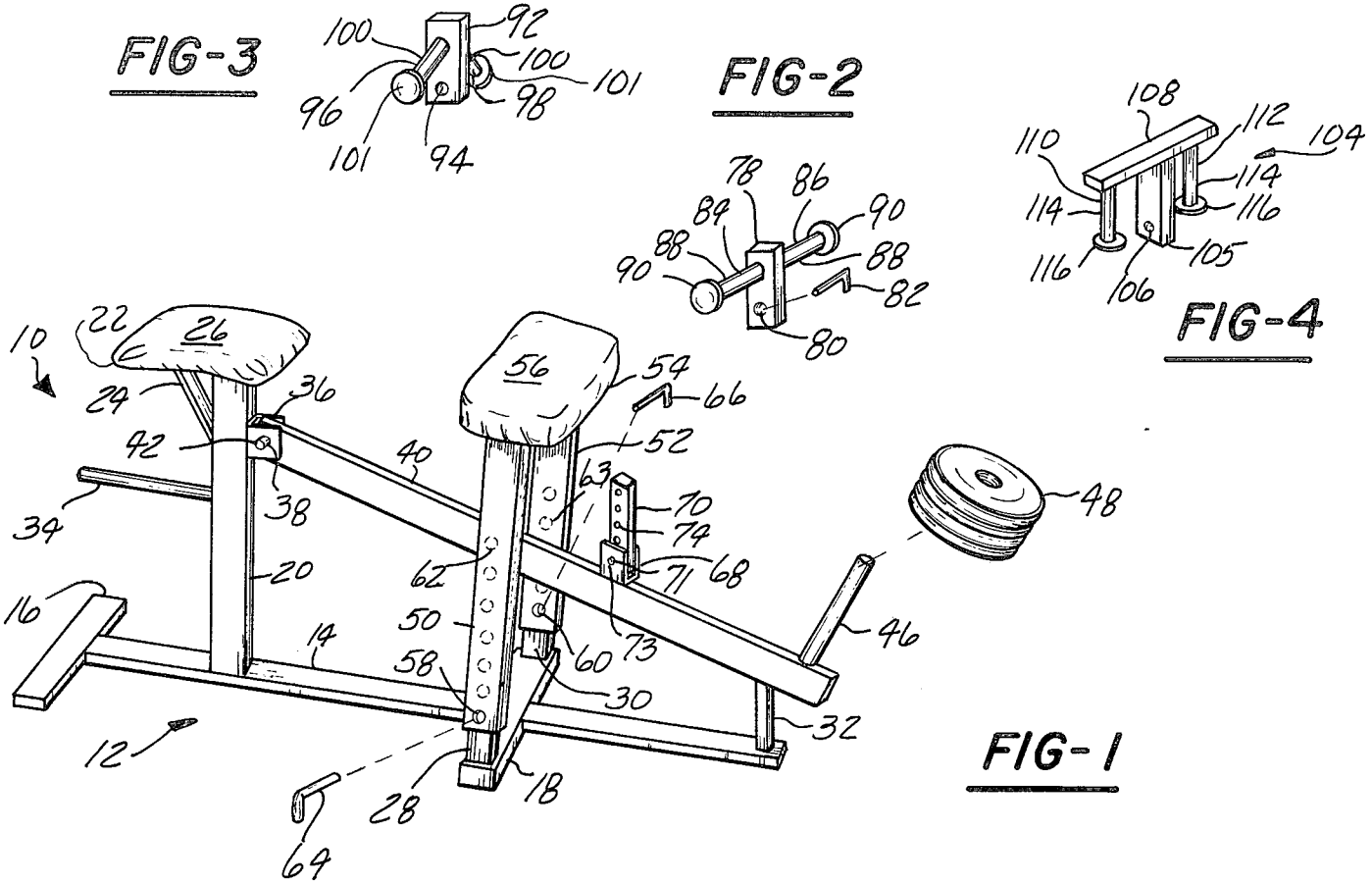
FIG. 1 illustrates a perspective view of the exercise device of the present invention.
FIG. 2 illustrates a palms up wrist curl attachment.
FIG. 3 illustrates a palms down wrist curl attachment.
FIG. 4 illustrates a palms facing each other attachment.

Referring now to the drawing and in particular to FIG. 1 wherein there is illustrated at 10 a perspective view of the preferred embodiment of the exercise device of the present invention. The exercise device of the present invention comprises a base 12 of welded construction made from square cross section tubing. The base 12 further comprises a longitudinal bar 14 having at a rear end thereof a first cross bar 16 welded thereto and a second cross bar 18 spaced forward of the first cross bar 16 a distance, extending transversely and affixed to the longitudinal bar 14 by welding or the like. A seat support 20 is vertically attached to the longitudinal bar 14 spaced forward of the first cross bar 16 and rearward of the second cross bar 18 by welding or other suitable means. A pad support 22 comprising a planar member deployed in a horizontal plane is affixed to a top portion of the seat support 20 by welding or other suitable means. A bracket 24 extends at an angle between the pad support and the seat support to add stability to the pad support. A padded seat 26 overlays the pad support 22 to render comfort to a person sitting thereon. A pair of opposed vertical supports 28, 30 extend vertically upward from end portions of the second cross bar 18. A pivot stop 32 extends vertically upward a distance at a forward end of the longitudinal bar 14 to support a forward end of a pivoted lever 40 which will be described subsequently.

A weight holding pin 34 extends rearward from the seat support 20 and is positioned beneath the pad support 22 and affixed to the seat support 20 by welding or other suitable means to provide a place to store a plurality of weights 48. A "U" shaped bracket 36 having a pair of opposed legs is attached to the seat support 20 by welding or other suitable means proximate the pad support 22 with the legs facing forward. A pair of aligned apertures 38 pass transversely through the legs of the "U" shaped bracket 36. The pivoted lever 40 comprises a longitudinal member extending from the seat support 20 to the forward end of the longitudinal bar 14. A lever aperture (not shown) is formed transversely through a rear end thereof. The lever aperture is aligned with the pair of aligned apertures 38 and a pivot pin 42 is forced into engagement with the pair of aligned apertures 38 and slidingly engaged with the lever aperture to pivotally support the pivoted lever 40 to the "U" shaped bracket 36. A weight support pin 46 is vertically affixed to the forward end of the pivoting lever 40 and is configured to selectively support the plurality of weights 48. A central aperture of the weights is slid over the pin 46 to retain the weights. The weight holding pin 34 is employed to store and support weights which are not placed over the weight supporting pin 46. A forward end of the lever rests on the pivot stop 32 when the weights are not being lifted.

A pair of opposed vertical sleeves 50, 52 telescopingly engage the pair of opposed vertical supports 28, 30 and a forearm pad support 54 of planar configuration disposed in a horizontal plane extends between the opposed vertical sleeves 50, 52 and is joined thereto by welding or other suitable means. A forearm pad 56 is attached atop the support 54. A pair of aligned apertures 58, 60 pass transversely through the vertical sleeves 50, 52 and are selectively aligned with a plurality of spaced aligned apertures 62, 63 which pass transversely through the pair of opposed vertical supports 28, 30 and a pair of pins 64, 66 slidingly engage the apertures 58, 60 and 62, 63, respectively to selectively position the forearm pad 56 at a desired height and define a means for adjusting the height of the forearm pad.

A pivoting bracket 68 is affixed to the pivoted lever forward of the forearm pad 56. The pivoting bracket comprises a pair of upward extending legs spaced apart, the opening running parallel to the pivoted lever 40. An attachment post 70 is pivotally attached to the pivoting bracket 68 by means of a pair of aligned apertures 71 passing through the legs of the bracket apertures 71 are aligned with an aperture at a lower end of the attachment post (not shown) and a pivoting pin 73 forceably passes through the apertures 71 in the legs and slidingly engages the aperture in the attachment post. A plurality of spaced longitudinal apertures 74 are spaced along the attachment post 70 which will be described more fully hereinbelow.

A palms up wrist curl attachment means (FIG. 2) comprises a first sleeve 78 slidingly engaging the attachment post 70, a pair of opposed aligned apertures 80 across the sleeve configured to be selectively aligned with one of the plurality of spaced apertures 74 in the attachment post, and a lock pin 82 to engage the apertures 80 in the sleeve 78 and one of the spaced apertures 74 in the attachment post to selectively attach the sleeve to the attachment post. A pair of cross pins 84, 86 are affixed to the sleeve extending horizontally and transversely from the sleeve. A first pair of tubes 88 slidingly engage the cross pins, and a threaded aperture formed in an outward end of each cross pin threadingly receives a large headed threaded fastener 90 to retain the tube thereon.

A palms down wrist curl attachment (FIG. 3) is provided comprising a second sleeve 92 engaging the attachment post 70, a second pair of opposed aligned apertures 94 across the sleeve configured to be selectively aligned with one of the plurality of spaced apertures 74 in the attachment post, and a lock pin, not shown, to engage the apertures 94 in the sleeve 92 and one of the spaced apertures 74 in the attachment post to selectively attach the sleeve to the attachment post. A second pair of cross pins 96,98 are affixed to the second sleeve 92 extending transversely outward and downward from the sleeve. A second pair of tubes 100 slidingly engage the cross pins 96, 98. A threaded aperture (not shown) formed in an outward end of each of the cross pins threadingly engages a large headed threaded fastener 101 having a round head exceeding the sleeve diameter to retain the tubes in position.

A palms facing each other lifting means 104 (FIG. 4) is provided comprising a third sleeve 105 slidingly engaging the attachment post 70, a third pair of opposed aligned apertures 106 extending across the sleeve configured to be selectively aligned with one of the plurality of spaced apertures 74 in the attachment post 70, and a lock pin, not shown, to engage the apertures 106 in the sleeve and one of the spaced apertures 74 in the attachment post to selectively attach the sleeve to the attachment post. A cross member 108 of planar configuration is affixed at an upper end of the third sleeve 105 extending transversely outward. A pair of downward extending pins 110,112 are affixed to the outer ends of the cross member 108, and a third pair of sleeves 114 slidingly engage the downward extending pins. A threaded aperture formed in a bottom end of each of the downward extending pins (not shown) receives the threaded end of a large headed threaded fastener 116 having a round head exceeding the sleeve diameter to retain the tubes thereon.

There has been described hereinabove an exercise device for selectively developing the muscles of the user's upper body including the user's arms, back, wrists, and shoulders. A plurality of hand engaging lifting means are provided which can be selectively used to provide a palms up wrist curl attachment, a palms down wrist curl attachment, and a palms facing each other lifting attachment.

Having thus described my invention what I claim is:

1. An exercise device for selectively developing the muscles of the user's arms, wrists, and shoulders comprising:

a base;

a seat supported above the base;

a forearm pad disposed forward of the seat and supported above the base;

a pivoted lever pivoted at a rearward end to a seat support, a forward end extending past the forearm pad a distance;

a weight supporting pin extending vertically upward from the lever forward end;

an attachment post pivotally attached to the pivoted lever forward of the forearm rest;

a lifting means selectively attached to the attachment post and adapted to be grasped by the user's hands; and a plurality of weights selectively attached to the weight supporting pin.

2. The exercise device as defined in claim 1 wherein the base further comprises:

a longitudinal bar including a rear end rearward of the seat, and a front end terminating forward of the forearm pad;

a first cross bar extending transversely to the longitudinal bar at the rear end;

a second cross bar extending transversely to the longitudinal bar vertically beneath the forearm pad;

a pair of opposed vertical supports extending vertically upward from the ends of the second cross bar to the forearm pad;

a pivot stop extending vertically upward from the forward end of the longitudinal bar to support the pivoted lever at rest;

a seat support extending vertically from the longitudinal bar to the seat;

a weight holding pin extending horizontally rearward from the seat support between the base and the seat;

a first "U" shaped bracket affixed to the seat support with an open end extending forward; and a lever aperture formed in the first end of the pivoted lever, a pair of aligned apertures formed in the bracket aligned with the lever aperture, a pivot pin engaging the pair of apertures and the lever aperture to form a pivot.

3. The exercise device as defined in claim 2 further including means for adjusting the height of the forearm pad, the means comprising:

a pair of opposed vertical sleeves telescopingly engaging the opposed vertical supports;

a plurality of spaced and aligned apertures formed in the vertical supports;

a pair of aligned apertures formed in the opposed sleeves configured to be selectively aligned with a pair of aligned apertures in the vertical supports, and a pin to engage the aligned apertures affixing the sleeves to the vertical support at a selected height; and a forearm pad support interconnecting an upper end of the pair of opposed vertical sleeves.

4. The exercise device as defined in claim 1 wherein the attachment post comprises:

a "U" shaped bracket affixed to the pivoted lever forward of the seat, an open end of the bracket facing upward;

a pivoting bar slidingly engaging the open end;

a pair of opposed apertures formed in the bracket, an aperture formed in the pivoting bar aligned with the pair of apertures and a pin slidingly engaging the opposed apertures and the aperture in the pivoting bar to pivotally attach the pivoting bar to the pivoted lever; and a plurality of spaced apertures through the pivoting bar.

5. The exercise device as defined in claim 4 wherein the lifting means comprises a palms up lift curl attachment comprising:

a first sleeve slidingly engaging the attachment post;

a pair of opposed aligned apertures across the sleeve configured to be selectively aligned with one of the plurality of spaced apertures in the attachment post;

a lock pin to engage the apertures in the sleeve and one of the spaced apertures in the attachment post and selectively attach the sleeve to the attachment post;

a pair of cross pins affixed to the sleeve and extending horizontally and transversely from the sleeve;

a first pair of tubes slidingly engaging the cross pins; and a threaded aperture formed in an outward end of each of the cross pins, a pair of large headed threaded fasteners including a round head exceeding the sleeve diameter threadingly engaging the threaded apertures to retain the tubes thereon.

6. The exercise device as defined in claim 4 wherein the lifting means comprises a palms down wrist curl attachment comprising:

a sleeve slidingly engaging the attachment post;

a pair of opposed aligned apertures across the sleeve configured to be selectively aligned with one of the plurality of spaced apertures in the attachment post;

a pin to engage the apertures in the sleeve and one of the spaced apertures in the attachment post and selectively attach the sleeve to the attachment post;

a pair of cross pins affixed the sleeve extending transversely outward and downward from the sleeve;

a pair of tubes slidingly engaging the cross pins; and a threaded aperture formed in an outward end of each of the cross pins, a pair of large headed threaded fasteners including a round head exceeding the sleeve diameter threadingly engaging the threaded apertures to retain the tubes thereon.

7. The exercise device as defined in claim 4 wherein the lifting means comprises a palm facing each other attachment comprising:

a sleeve slidingly engaging the attachment post;

a pair of opposed aligned apertures across the sleeve configured to be selectively aligned with one of the plurality of spaced apertures in the attachment post;

a pin to engage the apertures in the sleeve and one of the spaced apertures in the attachment post and selectively attach the sleeve to the attachment post;

a cross member affixed the sleeve extending transversely outward;

a pair of downward extending pins affixed to the outer ends of the cross member;

a pair of tubes slidingly engaging the downward extending pins; and a threaded aperture formed in a bottom end of each of the downward extending pins, a pair of large headed threaded fasteners including a rounded head exceeding the sleeve diameter each threadingly engaging the threaded apertures to retain the tubes thereon.

8. The exercise device as defined in claim 1 wherein the attachment post means comprises:

a bar;

means for pivotally attaching the bar to the pivoted lever forward of the forearm pad.

9. The exercise device as defined in claim 8 wherein the attaching means comprises:

a "U" shaped bracket affixed to the pivoted lever forward of the forearm pad, an open end of the bracket facing upward;

a bar slidingly engaging the open end;

a pair of aligned opposed apertures formed in the bracket, an aperture formed in the bar aligned with the pair of apertures in the bracket and a pin slidingly engaging the opposed apertures in the bracket and the aperture in the bar to pivotally attach the bar to the pivoted lever.

10. The exercise device as defined in claim 9 further including means for adjusting the height of the end of the bar with respect to the pivoted lever.

11. The exercise device as defined in claim 10 wherein the means for adjusting the height of the end of the bar comprises a plurality of spaced aligned apertures along the bar.

12. An exercise device for selectively developing the muscles of the user's arms, wrists and shoulders comprising:

a base;

a seat supported above the base;

a forearm pad disposed forward of the seat and supported above the base;

a pivoted lever pivoted at a rearward end to a seat support, a forward end extending past the forearm pad a distance;

means for attaching selected weights at the forward end of the pivoted lever;

lifting means adapted to be grasped by the hands of the user; and means for pivotally attaching the lifting means to the pivoted lever forward of the forearm pad.

13. The exercise device as defined in claim 12 wherein the means for attaching weights comprises a weight supporting pin extending substantially vertically upward from the lever forward end and adapted to receive weights thereon.

14. The exercise device as defined in claim 12 further including means for adjusting the height of the forearm pad with respect to the base.

15. The exercise device as defined in claim 14 wherein the forearm pad height adjusting means comprises:

a pair of opposed, spaced vertical supports extending vertically upward from the base to the forearm pad;

a pair of opposed, spaced vertical sleeves telescopingly engaging the opposed vertical supports;

a plurality of spaced and aligned apertures formed in the vertical supports; and a pair of aligned apertures formed in the opposed sleeves configured to be selectively aligned with a pair of aligned apertures in the vertical supports, and a pin to engage the aligned apertures affixing the sleeves to the vertical supports at a selected height.

16. The exercise device as defined in claim 12 wherein the means for attaching the lifting means comprises:

a bar; and means for pivotally attaching the bar to the pivoted lever forward of the forearm pad.

* * * * *